US006389781B1

(12) United States Patent
Ghirlandi

(10) Patent No.: US 6,389,781 B1
(45) Date of Patent: May 21, 2002

(54) TWO-LOBED FILTER BAG FOR PRODUCTS FOR INFUSION

(75) Inventor: Dante Ghirlandi, Bologna (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/651,256

(22) Filed: Aug. 30, 2000

Related U.S. Application Data

(62) Division of application No. 09/239,517, filed on Jan. 29, 1999, now abandoned.

(30) Foreign Application Priority Data

Jan. 30, 1998 (IT) ..... BO98A0044

(51) Int. Cl.[7] ..... B65B 29/04
(52) U.S. Cl. ..... 53/413; 53/134.2
(58) Field of Search ..... 53/413, 414, 134.2; 206/0.5; 426/77, 78, 79, 80, 81, 82, 83, 84

(56) References Cited

U.S. PATENT DOCUMENTS

| | | | | | |
|---|---|---|---|---|---|
| 2,791,505 | A | * | 5/1957 | Barnett | 53/134.2 |
| 2,852,389 | A | * | 9/1958 | Johnson | 426/83 |
| 3,191,355 | A | | 6/1965 | Morpurgo | 53/134 |
| 4,055,668 | A | * | 10/1977 | Kopp | 53/134.2 |
| 4,828,851 | A | * | 5/1989 | Romagnoli | 53/134.2 |
| 5,135,762 | A | * | 8/1992 | Veernon | 53/134.2 |
| 5,863,575 | A | | 1/1999 | Kuipers et al. | 426/80 |
| 5,871,789 | A | | 2/1999 | Romagnolii | 426/77 |

FOREIGN PATENT DOCUMENTS

| | | | | |
|---|---|---|---|---|
| EP | 448 325 A1 | | 9/1991 | |
| EP | 0 842 852 A1 | | 5/1998 | |
| EP | 0842852 A | * | 5/1998 | 53/134.2 |
| GB | 23126/51 | | 7/1957 | |
| IT | 11 87308 | | 12/1987 | |

* cited by examiner

*Primary Examiner*—John Sipos
(74) *Attorney, Agent, or Firm*—Arent Fox Kintner Plotkin & Kahn, PLLC

(57) ABSTRACT

In a two-lobed filter bag for products for infusion, the end of a thread connecting the filter bag to a pick-up label, consisting of a length of thread, is attached to the corresponding lobe, defining a loop, that is to say, a stable, extensive contact surface between the thread and the lobe, with a high degree of resistance to their separation; the base of the filter bag also has a storage zone which, in the packaging configuration, stably holds an additional portion of thread, allowing a longer length of thread to extend around the filter bag, said length of thread always being longer than the perimeter of the bag.

3 Claims, 2 Drawing Sheets

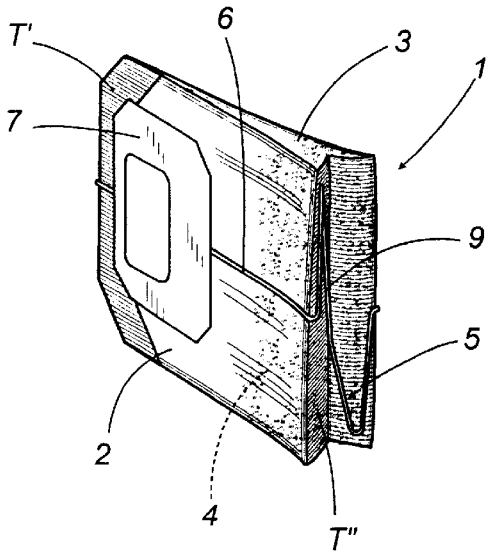
FIG.4
FIG.5
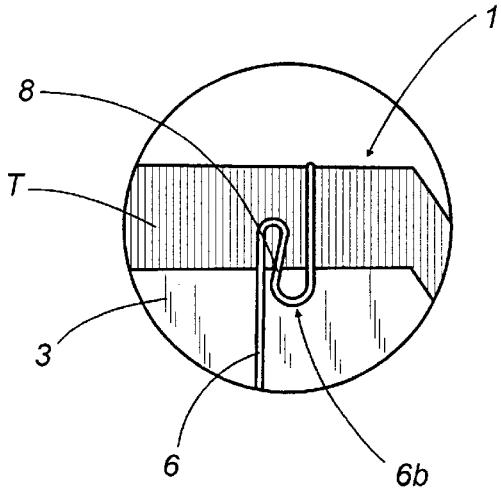
FIG.6
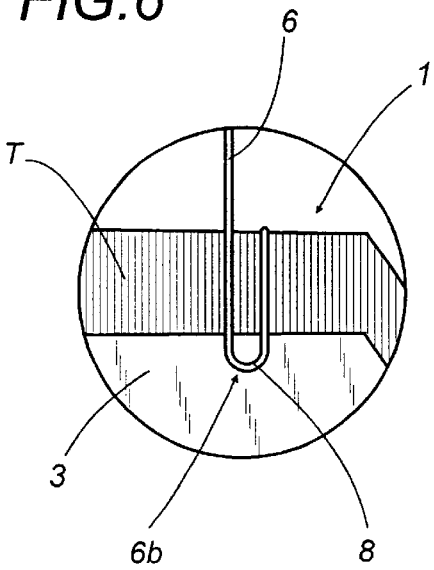
FIG.7
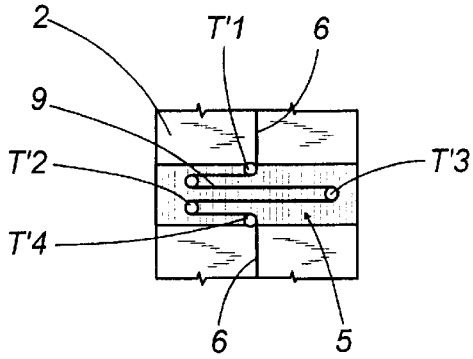

TWO-LOBED FILTER BAG FOR PRODUCTS FOR INFUSION

This is a division of application Ser. No. 09/239,517, filed Jan. 29, 1999, now abandoned.

BACKGROUND OF THE INVENTION

The present invention relates to a two-lobed filter bag for products for infusion, such as tea, chamomile and similar products.

The constant increase over time in the use of filter bags for products for infusion, both in private households and in public establishments, has lead to increasing research, especially by product distributors, into the differentiation of the individual package, improving its product holding capacity, its exchange with the liquid during the infusion time, its shelf life, ease of final packaging, etc.

For example, the original single lobe bag with pick-up label was succeeded by the classic and now established two-lobed bag (again with thread and label, with or without individual wrapper), whose special feature is improved release of the product, thanks to the greater surface for contact with the liquid; this type of bag being of particular interest in the present text.

To these product requirements relative to its commercial aspect are added the requirements of the production sector, that tend, as far as possible, to simplify the machines for the manufacture of such two-lobed bags, whose final construction is not simple. In an attempt to reduce the cost of the individual products, manufacturers employed solutions which could increase the productivity of the machines, or other solutions which could use diverse basic products. For example, the use of heat-sealable or non-heat-sealable filter paper, elements which seal the bags using a metal staple, gluing or "additional blobs" of heat-sealable material and the use of adhesive or non-adhesive labels.

The present text does not refer to the sector of the classic two-lobed bag sealed and attached to the thread and label using metal staples. Amongst the solutions which envisage the use of heat-sealable filter paper, the technique illustrated, for example, in patent IT-1.187.308 is known, in which the two-lobed bags are obtained from a continuous sheet of filter paper, upon which a succession of doses are placed, at equal distances from one another then, for each bag, a tubular section of filter paper is defined during a tube forming stage in which it is closed by folding and longitudinal sealing.

The two pockets of the bag are defined by a series of transversal seals, creating separate pockets or lobes, each with a base and free end. A continuously fed thread is then positioned centrally and longitudinally on the tubular sheet, labels already being attached to the thread, at regular intervals, by a blob of heat-sealable material.

Positioning of the thread is followed by a stage in which the tubular sheet is cut to define a tubular section comprising two pockets or lobes and a length of thread, the ends of which are attached to the free ends of the pockets by the above-mentioned blob of heat-sealable material. In the center of the section thus obtained a characteristic "W"-shaped fold is then made, allowing separation of the two opposite lobes or chambers. The two lobes are then rotated about the fold, until they are alongside one another, then they are stably joined by heat-sealing to form the filter bag as a whole, that is to say, with a thread extending longitudinally and wrapped around the package.

In a different solution, see patent EP-448.325, the filter bag comprises two chambers or lobes obtained from a pair of sheets, fed one above the other, following the depositing of product doses, and heat-sealed at the edges, then folded one towards the other with the characteristic "W"-shaped fold. As in the previous case, the thread to which the label is attached may be wound longitudinally around the filter bag with its ends heat-sealed to the relative surfaces, or may be positioned on a single surface of the filter bag and gathered there under the pick-up label, which also serves to hold the thread in place.

Over time, such types of filter bags have displayed disadvantages due, in particular, to the complexity of the solution which uses the blob of heat-sealable material, the fragility of the zone at which the surface of the filter bag and the end of the thread are joined (normally by heat-sealing or blobs of glue—in a concentrated zone) and the shortness of the thread—joined to the length of the bag, as indicated above—for some infusion operations necessary, where very tall containers are used. The fragility of the join may cause the thread to be detached from the filter bag during preparation of the infusion or as it is removed from the container, whilst the shortness of the thread limits the conventional infusion maneuver, increasing the risk of the user being scalded.

SUMMARY OF THE INVENTION

The aim of the present invention is, therefore, to overcome the above-mentioned disadvantages by providing a filter bag which is practical and convenient to use, without changing those features of the typical two-lobed filter bag that are already good.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

FIGS. 2, 3 and 4 are respectively a front perspective view, a rear perspective view and a perspective view in which the base of the bag is visible, of the filter bag for products for infusion disclosed in a pre-packaging configuration;

FIGS. 5 and 6 are schematic front views, with some parts cut away, of a detail of the filter bag illustrated in the previous figures, respectively in a pre-use configuration and an infusion configuration;

FIG. 7 is a schematic plan view referred to FIG. 1 of an alternative embodiment of an additional section of thread positioned on the base of the filter bag.

DESCRIPTION OF THE PREFERRED EMBODIMENTS

Figure 2:
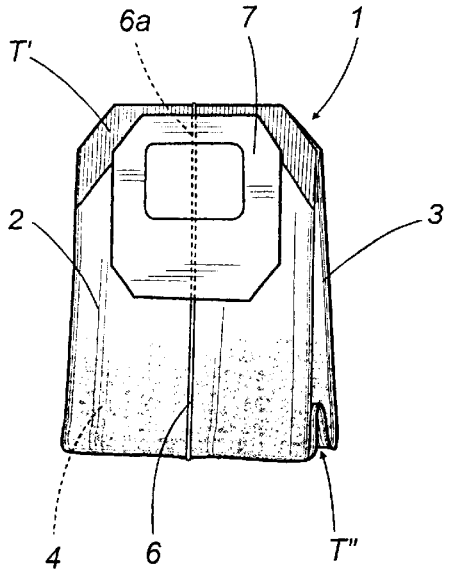
Figure 2:
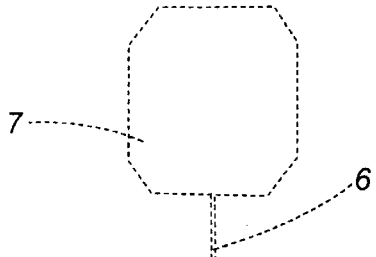
Figure 3:
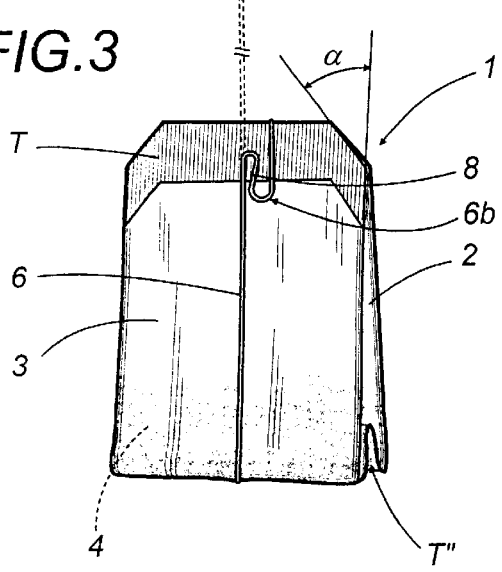

With reference to the accompanying drawings and in particular FIGS. 2, 3 and 4, the filter bag disclosed is of the two-lobed type for products for infusion, such as tea, chamomile and similar products.

Such a filter bag, labeled as a whole with the numeral 1, comprises two pockets or lobes 2 and 3, made of filter paper, each holding a dose 4 of the product for infusion. These lobes 2 and 3 are made from a section of heat-sealable filter paper and each is sealed transversally by heat-sealing operations. The lobes 2 and 3 are positioned in such a way that one surface of each is in contact with the other (see FIGS. 2 and 3) due to the heat-sealing of their relative free ends (effected on the seals labeled T and T' in the figures), whilst they remain joined together at the other end, defining the base 5 of the filter bag 1 (see also FIG. 4) which, in the embodiment illustrated, is "W"-shaped.

A bag support thread 6 is attached to the filter bag 1 (for example, again by heat-sealing). In a filter bag 1 packaging configuration (again see FIGS. 2 and 3), the thread 6 is wound longitudinally around the two lobes 2 and 3.

The thread 6 is attached at its ends 6*a* and 6*b* to the relative outer surfaces of the lobes 2 and 3: in particular, a pick-up label 7 for manipulating the filter bag 1 during infusion is attached to the end 6*a* of the thread 6, whilst the other end 6*b*, during use, defines the point where the filter bag 1 is connected to the pick-up label 7.

In the present invention, the latter end 6*b* of the thread 6, defining the point where the filter bag 1 is connected to the filter bag 1 and the pick-up label 7, comprises a length 8 of thread attached to the corresponding lobe 3 by a loop, that is to say, a stable, extensive contact surface between the thread 6 and the lobe 3, with a high degree of resistance to separation of the two elements.

More specifically (see FIGS. 5 and 6), the length 8 of resistant thread defines a "U"-shaped loop, its concave side pointing towards the heat-sealed free end of the lobe 3 so that during the infusion stage (configuration also illustrated with a dashed line in FIG. 3) it has a higher degree of resistance to the forces applied to the filter bag 1 during the typical thread 6 pulling operation during infusion in water.

Figure 1:
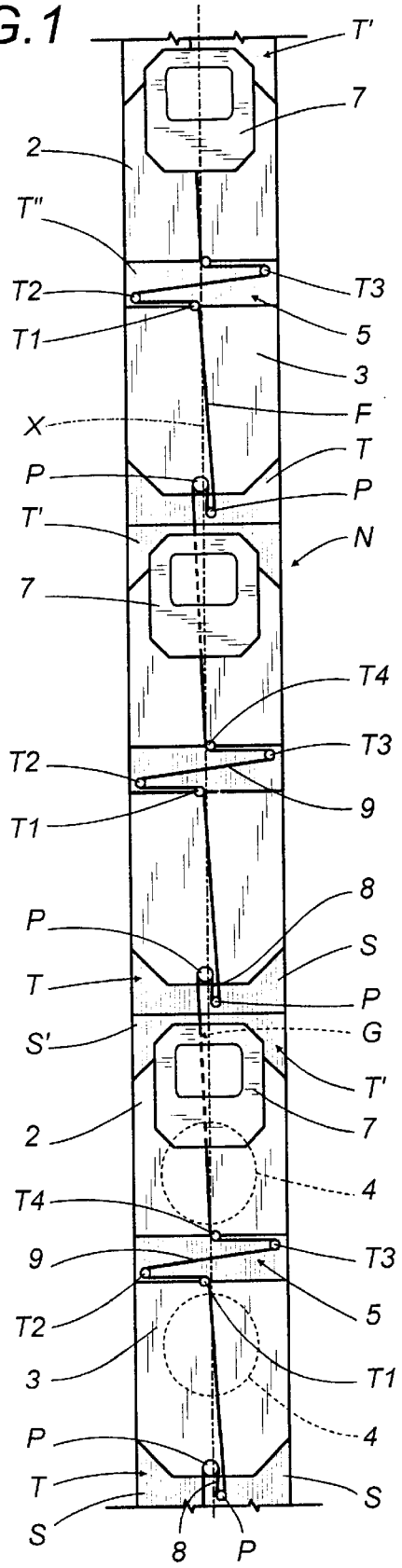
FIG. 1 is a schematic plan view of a tubular portion from which the two-lobed filter bag disclosed is obtained.

The entire "U"-shaped length 8 of thread, that is to say, the entire loop, as can also be seen in FIGS. 1 and 3, is preferably attached to the upper end of the lobe 3 by "strong"-heat-sealing: in other words, the heat-sealed section T and T' which, in the previous stages, sealed the upper mouth of the filter bag 1, then was operated upon to simultaneously join the two lobes 2 and 3, also involves the "U"-shaped length of thread. More specifically, on the heat-sealed section T of the upper end of the lobe 3, a further operation is carried out to join the "U"-shaped length of the thread 6, making use of the intrinsic feature of the bag 1 filter paper, the inside of which is impregnated with an adhesive that is drawn out during heat-sealing of the thread 6 on the section T of the bag 1.

FIGS. 1 to 4 show how the above-mentioned sections T and T' of the bag have an edge profile S and S' tapered symmetrically relative to the line along which the sections T and T' extend, that is to say, at an angle $\alpha$.

As is more clearly shown in FIGS. 1 and 4, the base 5 of the filter bag 1 defined by folding the relative ends of the two lobes 2 and 3, defines a storage zone which, in the packaging configuration, stably holds an additional portion 9 of thread, designed to allow a longer length of thread to extend around the filter bag 1, said length of thread being longer than the perimeter of the bag measured longitudinally.

More specifically, this additional portion 9 of thread extends inside the base 5 in a zigzag so that it occupies the minimum possible space and does not increase the thickness of the filter bag 1 in the packaging configuration (which may also have an outer wrapper, not illustrated), and so that the zone at which the thread 6 enters and exits the base 5 is always at the median zones of the adjacent lobes 2 and 3, avoiding any change in the outer appearance of the filter bag 1.

The zigzag configuration of the portion 9 of thread inside the base 5 is obtained by "weak" heat-sealing of the portion along its path at a plurality of points labeled T1, T2, T3 and T4 (see FIG. 1), thus allowing it to be detached during use.

FIG. 7 illustrates an alternative embodiment of the extension of the additional portion 9 of thread, again in a zigzag (according to points labeled T'1, T'2, T'3, T'4), but in directions which gradually bring the branches of the portion 9 of thread on the base 5 of the filter bag 1 parallel with one another.

A filter bag 1 of this design fulfils the above-mentioned aims thanks to a system for attaching the thread to the bag which is extremely practical and simple to effect, yet provides a high degree of resistance when the filter bag is picked up or manipulated during infusion. This increased resistance of the thread—bag connection is given by the particular arrangement of the loop 8 and its angling, which is better at preventing the thread from being detached from the anchoring zone. This solution increases the contact (or, more precisely, sealing) surface and, at the same time, creates a winding path that prevents the above-mentioned detachment of the thread from the bag.

Moreover, the added thread, "hidden" in the base of the bag, allows the latter to be used even in very tall infusion containers without changing the bag alternate movement stage, and reduces the risk of the user being scalded while the product is being infused. All of this is possible whilst maintaining the structure and appearance of the bag and, as a result, most of the stages required for its manufacture, practically unchanged.

FIG. 1 also shows how the thread can be attached at a plurality of points to the tube of filter paper in a continuous cycle automatic machine. In this case, the tube N of filter paper is defined continuously by the set-down of doses 4 of product on the sheet, evenly distributed along its length.

The sheet is then folded along the longitudinal axis and sealed to form individual lobes 2 and 3 at equal distances from one another, by a series of longitudinal and transversal seals. The latter, in groups of three, then define the filter bag 1; two transversal seals, each comprising of longitudinal halves T and T', define the ends of the bag 1, whilst the complete intermediate seal T" defines the base 5 of the bag.

The continuous thread F is then laid over the tubular sheet N obtained. Pick-up labels 7 are attached to the thread at preset intervals, and the thread is initially held in a pattern again indicated in FIG. 1 using generic "peg" elements P around which the thread is wound with the "U"-shaped length 8 on one half T of a seal and a section G of the continuous thread F, where it is attached to the pick-up label 7, on the other half T', whilst the additional portion 9 of thread, already in a zigzag shape, is positioned over the intermediate seal T".

The thread F is then heat-sealed to the transversal seal zones T, T' and T" of the tubular sheet N, for example using a pressure and heat exchange device (not illustrated) with different heat exchange zones which allow "strong" sealing of the looped length 8 of thread and "weak" or weaker sealing of sections T1–T4 or T'1–T'4 and section G.

When the thread has been positioned and heat-sealed, the section of filter paper is separated from the rest of the continuous sheet N by cutting and the edges S and S' of the ends of the halves T and T' of the transversal seals are subjected to a further cut at an angle $\alpha$ so that they have a substantially tapered profile.

During subsequent stages, of the known type, the base is formed into a "W" and the two lobes are folded towards one another until the two free ends are heat-sealed together, creating the known configuration illustrated in FIGS. 2, 3 and 4.

The present invention may be subject to numerous modifications and variations, all encompassed by the design concept. Moreover, all components may be substituted with technically equivalent parts.

What is claimed is:

1. A method of forming a two-lobed filter bag for products for infusion, the method comprising the following steps:

evenly depositing doses of the products to be infused for infusion on the upper surface of a sheet of heat-sealable filter paper;

folding the sheet of heat-sealable filter paper along a longitudinal axis;

heat-sealing the folded sheet of heat sealable filter paper by a series of longitudinal and transversal seals, wherein a continuous sealed tubular sheet divided into individual lobes at regular distances from one another is defined, wherein each pair of lobes defines an individual filter bag; each filter bag being delimited by two different transversal end seals having longitudinal halves that include the two ends of the filter bag, and a complete intermediate seal between the two different transversal end seals that defines the base of each filter bag;

depositing a continuous thread onto the upper surface of the tubular sheet, wherein the continuous thread includes a pick-up label attached to the thread at regular distances from the two lobes;

defining a loop of thread lying on a half of one of the transversal seals, wherein an extensive contact surface between the continuous thread and the lobe is created; on a half of the other transversal seal includes a section of thread to which the pick-up label is attached;

defining an additional portion of thread lying along a zig-zag path on the intermediate transversal seal;

heat-sealing the looped length of thread to the upper surface of the tubular sheet at the half of the transversal seal without penetrating the thread through the sheet;

heat-sealing the additional portion of thread to the upper surface of the tubular sheet at intermediate transversal seal without penetrating the thread through the sheet;

heat-sealing the section of thread to which the pick-up label is attached to the upper surface of the tubular sheet without penetrating the thread through the sheet;

cutting the transversal end seals into halves to define the two lobes of each filter bag; and folding the two lobes towards one another until the two free ends are heat-sealed together to define a filter bag packaging configuration in which the thread is wound longitudinally around the two lobes and attached at an end of thread to outer surfaces of the lobes.

2. The method according to claim 1 comprising the additional step of cutting edges of the halves of the transversal end seals at an angle to define a substantially tapered profile.

3. The method according to claim 1, wherein the step of heat-sealing the looped length of thread is stronger than the heat-sealing of the additional portion of thread and the section of thread attached to the pick-up label, so that, when the filter bag is used, the looped length of thread remains attached to the lobes while the section of thread and the additional portion of thread may be detached.

* * * * *